United States Patent [19]

Yoshida

[11] 4,159,054

[45] Jun. 26, 1979

[54] PROTECTIVE DEVICE FOR DISPENSING MACHINES AND THE LIKE HAVING OPENINGS

[76] Inventor: Don K. Yoshida, 19936 Mildred Ave., Torrance, Calif. 90503

[21] Appl. No.: 848,617

[22] Filed: Nov. 4, 1977

[51] Int. Cl.[2] ..... G07F 7/00

[52] U.S. Cl. ..... 194/1 A; 194/DIG. 26; 232/15

[58] Field of Search ..... 194/1 R, 1 A, 1 B, 1 E, 194/4 R–4 G, 92, 93, DIG. 26; 109/19; 232/14, 15

[56] References Cited

U.S. PATENT DOCUMENTS

| | | | |
|---|---|---|---|
| 1,190,881 | 7/1916 | Ericksen | 194/93 |
| 1,941,826 | 1/1934 | Card | 194/93 X |
| 3,056,132 | 9/1962 | Simjian | 194/1 E X |
| 3,410,384 | 11/1968 | Travioli | 194/4 R |
| 3,774,742 | 11/1973 | Magnanelli | 194/1 R |

*Primary Examiner*—Francis J. Bartuska

*Attorney, Agent, or Firm*—Albert M. Herzig; Edward C. Walsh

[57] ABSTRACT

A protective armor device adapted for use with machines having openings, particularly slot openings such as bill changers and the like. An armored frame is provided that can be secured to a machine with an opening such as a slot overlying the slot opening in the machine. The armored frame has a rigid bar adjacent to and overlying the slot opening. It also has a protective shield spaced outwardly from the opening and the bar, having a top edge at a level above the bar. The spacing of the bar and the top edge and the height of the top edge is set so that it is impossible to insert a crowbar or the like into the opening in the face plate and in the machine.

2 Claims, 4 Drawing Figures

PROTECTIVE DEVICE FOR DISPENSING MACHINES AND THE LIKE HAVING OPENINGS

BACKGROUND OF THE INVENTION

1. Field of the Invention

The field of the invention is that of protecting machines and apparatus which are exposed for use by the public from robbery and damage inflicted by vandals and thieves. Particularly, the invention is concerned with protection of such machines which have openings, such as, for example, dollar bill changers which have a slot opening that accommodates a tray which receives the dollar bill and which moves in and out. Typically, inside of the front wall of such machines is a sensitive electronic verifier mechanism which can read and verify the bill. The field of the invention is that of protection of machines and apparatus of this type and in this category.

2. Description of the Prior Art

Conventionally known dollar bill changers are exemplary of known machines and apparatus wherein protection from thieves and vandals is needed and which is presently lacking in the art. Machines and apparatus such as these are used in many places where there is need to change dollar bills into coins and there is no attendant or cashier present to provide such service. Thus, machines of this type are needed in places such as laundromats, postal stations, food vending establishments, etc. Typically, thieves and vandals break into the machine or apparatus through the rectangular or slot opening in the machine in which the tray for the dollar bill operates, sliding in and out. By means of a pry bar or screw driver working an up-and-down motion, such individuals, in a few seconds in attempting to break into the machine to steal money, cause sufficient damage to components of it to render it unusable and beyond repair. This is particularly true with respect to apparatus of the type referred to wherein a delicate electronic verifier or other mechanism is present in the machine directly behind its front wall adjacent to the opening. Bill changing apparatus typically includes an optical scanner and electronic sensing mechanism for verifying in a position directly above the tray. The cost of replacement of these components is typically prohibitive.

SUMMARY OF THE INVENTION

In the exemplary form of the invention as described in detail herein, it takes the form of an armored device or armor plate constructed to fit against the surface of a machine or apparatus which is to be protected. The armor device includes a frame or face plate attachable to the surface of the machine, the frame having an opening which is positioned in registry or juxtaposition over the opening in the machine or apparatus. Typically, the opening in the machine may be a horizontal slot. The frame embodies a rigid bar which is directly over the slot in the frame.

The armor device or frame includes a rigid shield part which is spaced outwardly from the face plate of the frame and outwardly from the slot and the rigid bar. The shield has a top edge spaced upwardly from the rigid bar and the adjacent slot. The shield may include sidewalls and a bottom part extending outwardly from the frame or face plate. The top edge of the outer wall of the shield is at a sufficient distance above the rigid bar so that a pry bar or similar instrument that is attempted to be inserted over the top edge of the shield and under the pry bar is at such an angle that it cannot be inserted into the opening in the machine where it could damage delicate parts.

Preferably, also, the armor device may have a top wall so that in effect it forms a housing with the front opening which is over the top edge of the shield. The relative position of the horizontal bar and the top edge of the shield are such that it is possible to reach through the opening in the housing as described for purposes of manipulating the bill tray.

In the light of the foregoing, a primary object of the invention is to provide means, and to make it possible to have protection against thieves and vandals as respects machines or apparatus having openings such as slots through which the machine can be attacked with a pry bar or the like.

A further object is to provide a protective defense plate or piece or armor which is attachable to the machine or apparatus, the protective armor having an opening which aligns with the opening in the machine and which has protective armor means positioned adjacent the opening in a way to prevent insertion of a pry bar or other means into the opening of the machine.

A further object is to provide protective means as in the foregoing object wherein the armor includes a strong bar positioned closely adjacent to the openings in the machine with a shield spaced outwardly from the openings and having a top edge above the openings making it impossible to insert a pry bar or the like through the protective means into the openings.

Further objects and additional advantages of the invention will become apparent from the following detailed description and annexed drawings.

DESCRIPTION OF THE PREFERRED EMBODIMENT

Figure 1:
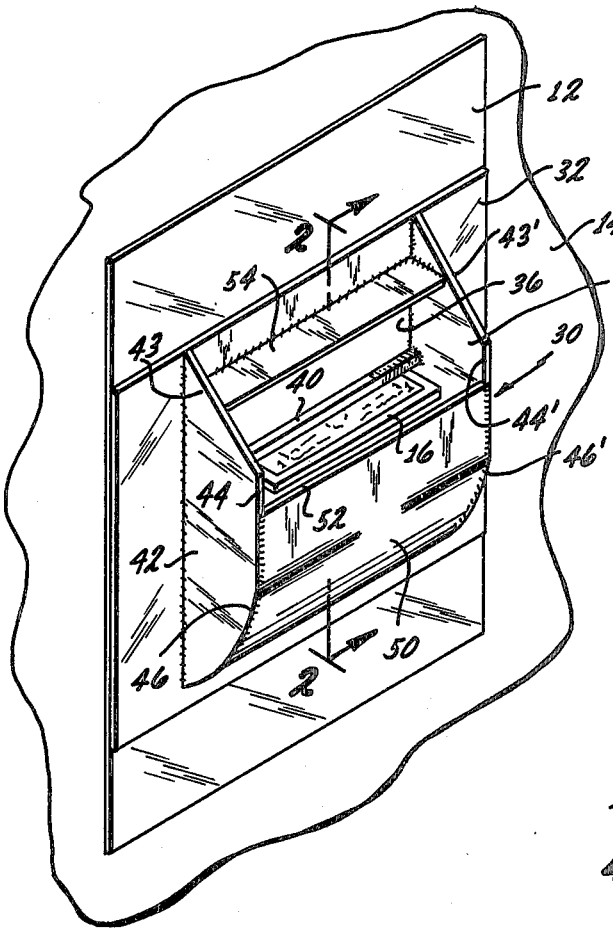
FIG. 1 is an isometric view of a preferred form of the invention in installed position.
Figure 2:
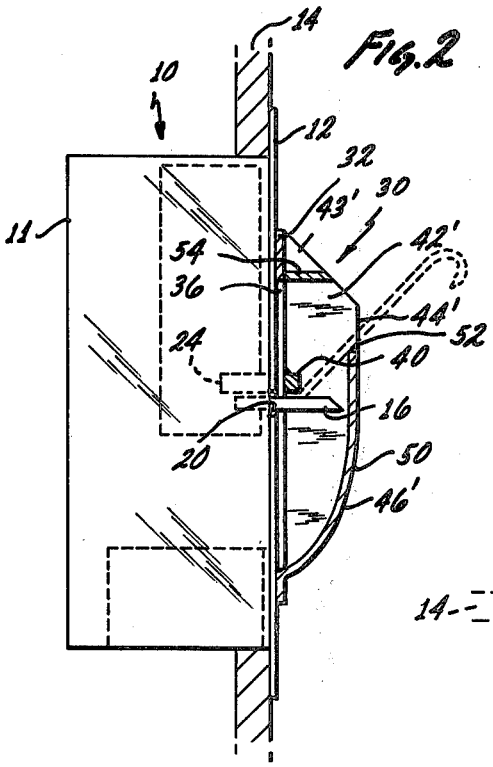
FIG. 2 is a cross-sectional view taken along the line 2—2 of FIG. 1.
Figure 3:
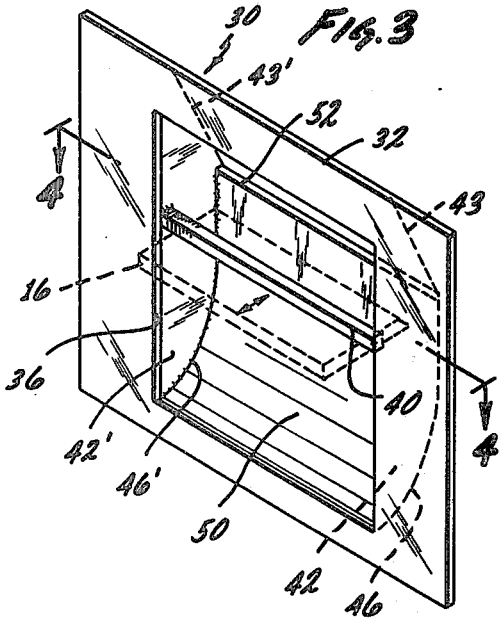
FIG. 3 is an isometric rear view of the form of the invention shown in FIGS. 1 and 2.

Referring to the drawings, numeral 10 is illustrative of a machine of the type which the invention is adapted to protect. By way of example, the machine is shown as a bill changer, the machine including a rectangular housing 11 having a front cover or face plate 12. The machine may be supported from a wall 14 as shown. As shown, the machine is a type which will receive a bill, such as a one dollar bill, and provide change for the bill. Numeral 16 designates a tray which can slide in and out in a slot 20 in the front cover plate 12 in the front of the machine. The tray 16 has a peripheral frame, as may be seen in FIG. 1. A dollar bill can be placed in the tray which is then pushed in into a position underneath a sensitive electronic verifier 24 which verifies or checks the authenticity of the bill. The verifier is, of course, a sensitive and delicate device which is readily susceptible to damage or destruction. A primary purpose of the invention is to provide protection for the verifier 24 or any similar type of component.

The protective armor device of the invention is designated generally by the numeral 30. It includes a face plate 32 which preferably is made of a suitable gauge of protective metal material. The plate or frame 32 is rectangular in shape as shown. In the plate 32 is a rectangular opening 36. Positioned extending across the opening 36 is a strong bar 40 which may be made of metal, for example, and which is secured at its ends by welding as will be described. It is in a position of overlying the slot in the front of the machine 10.

Figure 4:
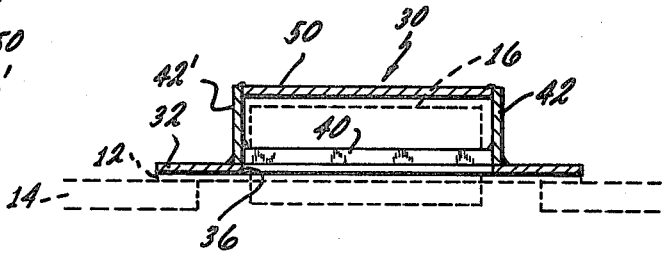
FIG. 4 is a sectional view taken along the line 4—4 of FIG. 3.

The protective device as shown, has two similar side plates 42 and 42'. The inner edges of these plates are welded to the plate 32 as may be seen in FIG. 1. The top edges of the plates have a downward slant or bevel as designated at 43 and 43'. The front edges have straight vertical portions 44 and 44'. At the lower part of the outer edges of the side plates 42 and 42', these edges have an inward curved taper as designated at 46 and 46'. Numeral 50 designates a front plate, the lower part of which is contoured to conform to the edges 46 and 46' of the side plates 42 and 42' and which is secured to them by welding. The front plate 50 forms a shield spaced outwardly from the opening 20 and the bar 40. The ends of the bar are secured by welding to the side plates 42 and 42' as may be seen in FIG. 4.

The top edge 52 is spaced upwardly from the bar 40 and the slot 20 to prevent the insertion of a pry bar as shown in dotted lines in such a way as to be able to get it into the slot 20. At the upper part of the protective frame is an inwardly extending member as designated at 54 and it is also secured to the plate 32 by welding.

The protective frame or armor, of course, is readily constructed of steel or other material that is sufficiently strong to resist penetration or breakage. As described, the parts can be suitably secured by welding. The protective frame can readily be secured to the front wall of the machine or apparatus to be protected in the manner illustrated, the slot registering with the slot or other opening in the machine and with the protective bar 40 adjacent to the opening. Thus, the shield of the protective device in association with the transverse bar allows access so that the slide 16 can readily be manipulated by the user but it is not possible to insert a pry bar or other similar instrument in such a way as to get it through the slots and into the machine where damage could be done. Thus, it is to be seen that the invention readily realizes and accomplishes the objectives as set forth in the foregoing. A thief or vandal who would otherwise damage or vandalize the machine would find his purposes so frustrated that he would abandon his original purpose of attempting to steal from the machine. This result is effected and realized in a relatively simple and economical way and achieves the result for preventing the damage that would otherwise occur to the machine and particularly the sensitive components thereof.

The foregoing disclosure is representative of a preferred form of the invention and is to be interpreted in an illustrative rather than a limiting sense, the invention to be accorded the full scope of the claims appended hereto.

What is claimed is:

1. A protective armor device for use with dispensing apparatus of a type having an opening therein in a surface thereof and which accommodates a member that slides into and out of said opening and having delicate mechanism within the apparatus adjacent to the opening, the device being in the form of a frame attachable in a position to be over the opening in the apparatus, the frame having a protective bar adjacent but above the opening in the apparatus, and the frame having a shield member spaced outwardly from the said opening in the apparatus, the said shield member having a top edge at a position above the level of the opening in the apparatus and sides extending above and below said opening whereby insertion of a pry bar between the said protective bar and the top edge of the shield and into the opening in the apparatus is prevented, but manual access to the slide member is permitted, said frame including face plate constructed to fit against said surface of the apparatus, the said face plate having an opening through it and the said protective bar extending across said opening and along said surface of the apparatus adjacent to the said opening in the apparatus.

2. A protective device as in claim 1 wherein the said shield member has a bottom portion which extend outwardly from the said face plate, the shield having an outer wall member the upper part of which provides said top edge and said sides extending outwardly from said face plate.

* * * * *